US011035067B2

(12) United States Patent
Son et al.

(10) Patent No.: US 11,035,067 B2
(45) **Date of Patent: *Jun. 15, 2021**

(54) LAUNDRY MACHINE

(71) Applicant: LG ELECTRONICS INC., Seoul (KR)

(72) Inventors: Kuyoung Son, Seoul (KR); Hyeokdeok Kim, Seoul (KR); Byunghwan Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/723,407

(22) Filed: Oct. 3, 2017

(65) Prior Publication Data

US 2018/0179684 A1 Jun. 28, 2018

Related U.S. Application Data

(63) Continuation of application No. 15/636,092, filed on Jun. 28, 2017.

(30) Foreign Application Priority Data

Dec. 28, 2016 (KR) ..... 10-2016-0181642

(51) Int. Cl.
*D06F 37/26* (2006.01)
*D06F 29/00* (2006.01)
(Continued)

(52) U.S. Cl.
CPC ..... *D06F 37/264* (2013.01); *D06F 29/00* (2013.01); *D06F 29/005* (2013.01);
(Continued)

(58) Field of Classification Search
CPC ..... D06F 29/00; D06F 31/00; D06F 37/24; D06F 37/245; D06F 37/264
See application file for complete search history.

(56) References Cited

U.S. PATENT DOCUMENTS 2,620,070 A * 12/1952 Dodge ..... D06F 37/263 210/360.1
6,564,594 B1 * 5/2003 Ito ..... D06F 23/06 68/140
(Continued)

FOREIGN PATENT DOCUMENTS

CN 202559115 11/2012
CN 102844486 12/2012
(Continued)

OTHER PUBLICATIONS

Australian Office Action in Application No. 2017204092, dated Dec. 20, 2017, 6 pages.
(Continued)

*Primary Examiner* — Joseph L. Perrin
(74) *Attorney, Agent, or Firm* — Fish & Richardson P.C.

(57) ABSTRACT

A laundry machine includes first and second washing units including first and second tubs, respectively. First and second drums are mounted inside the first and second tubs, and first and second drive units drive rotations of the first and second drums around first and second rotational shafts, respectively. The second washing unit is arranged above the first washing unit and has a smaller laundry treating capacity than the first washing unit. The first rotational shaft is not parallel to the second rotational shaft. A first recess projects downward from a rear lower surface of the second tub and is configured to heat wash water in the second tub. A metal plate member is provided on an outside lower surface of the second tub, and partially extends to the rear of the second tub to expose a bottom surface of the first recess.

24 Claims, 5 Drawing Sheets

(51) Int. Cl.

| | |
|---|---|
| ***D06F 25/00*** | (2006.01) |
| ***D06F 31/00*** | (2006.01) |
| *D06F 18/00* | (2006.01) |
| *D06F 21/08* | (2006.01) |
| *D06F 21/04* | (2006.01) |

(52) U.S. Cl.
CPC ..... *D06F 37/262* (2013.01); *D06F 37/267* (2013.01); *D06F 18/00* (2013.01); *D06F 21/04* (2013.01); *D06F 21/08* (2013.01); *D06F 25/00* (2013.01); *D06F 31/00* (2013.01)

(56) References Cited

U.S. PATENT DOCUMENTS

| | | | | |
|---|---|---|---|---|
| 8,434,180 | B2 * | 5/2013 | Lee | D06F 33/02 8/159 |
| 2006/0156765 | A1 * | 7/2006 | Sunshine | D06F 39/12 68/13 R |
| 2007/0119072 | A1 * | 5/2007 | Kim | D06F 29/00 34/596 |
| 2007/0151305 | A1 * | 7/2007 | Kendall | D06F 29/00 68/13 R |
| 2008/0022465 | A1 * | 1/2008 | Jun | D06F 31/00 8/158 |
| 2008/0271499 | A1 * | 11/2008 | Favaro | D06F 37/262 68/140 |
| 2009/0113945 | A1 * | 5/2009 | Kim | D06F 17/04 68/5 C |
| 2009/0133197 | A1 | 5/2009 | Lee et al. | |
| 2009/0145176 | A1 * | 6/2009 | Kim | D06F 39/125 68/27 |
| 2011/0265524 | A1 | 11/2011 | Kim et al. | |
| 2012/0222454 | A1 | 9/2012 | Park | |
| 2014/0196507 | A1 | 7/2014 | Lee et al. | |
| 2015/0135777 | A1 * | 5/2015 | Cho | D06F 31/00 68/27 |
| 2015/0259845 | A1 | 9/2015 | Doyle et al. | |
| 2016/0215432 | A1 | 7/2016 | Kim | |
| 2018/0080161 | A1 * | 3/2018 | Fricke | D06F 37/264 |

FOREIGN PATENT DOCUMENTS

| | | |
|---|---|---|
| CN | 204343050 | 5/2015 |
| CN | 104790168 | 7/2015 |
| CN | 105155198 | 12/2015 |
| CN | 105316892 | 2/2016 |
| CN | 106149276 | 11/2016 |
| CN | 106149277 | 11/2016 |
| JP | 2003-018879 | 1/2003 |
| JP | 2014-030660 | 2/2014 |
| WO | WO2016169526 A1 | 10/2016 |
| WO | WO2016173565 A1 | 11/2016 |

OTHER PUBLICATIONS

Extended European Search Report in European Application No. 17182650.6, dated Feb. 19, 2018, 10 pages.
Chinese Office Action in Chinese Application No. 201710640695.3, dated Dec. 4, 2019, 17 pages (with English translation).

* cited by examiner

LAUNDRY MACHINE

CROSS-REFERENCE TO RELATED APPLICATIONS

This application is a continuation of U.S. application Ser. No. 15/636,092, filed on Jun. 28, 2017, which claims the benefit of an earlier filing date and right of priority to Korean Patent Application No. 10-2016-0181642, filed on Dec. 28, 2016. The disclosures of the prior applications are incorporated by reference in their entirety.

TECHNICAL FIELD

The present disclosure generally relates to a laundry machine.

BACKGROUND

Generally, examples of laundry machines include washers for washing laundry, dryers for drying clothes, and laundry machines that perform both washing and drying of clothes.

Typically, a laundry machine implements two laundry treating devices, such as a tub and a drum, that have different volumes. Such laundry machines are typically referred to as twin laundry machines. Various types of clothes and laundry may be loaded and selectively washed, dried, and/or treated in such twin laundry machines, and such twin laundry machines sometimes include two different devices according to the types or amount of the laundry.

SUMMARY

In one aspect, a laundry machine may include a first washing unit including a first tub, a first drum mounted inside the first tub, and a first drive unit configured to drive a rotation of the first drum around a first rotational shaft inside the first tub. The laundry machine may also include a second washing unit including a second tub, a second drum mounted inside the second tub, and a second drive unit configured to drive a rotation of the second drum around a second rotational shaft inside the second tub. The second washing unit may be arranged above the first washing unit and may be configured with a second laundry treating capacity that is smaller than a first laundry treating capacity of the first washing unit. A diameter of the second drum may be larger than a height of the second drum. The first rotational shaft of the first washing unit may not be not parallel to the second rotational shaft of the second washing unit. The second drive unit may include a motor connected to the second rotational shaft of the second drum in an outer lower portion of the second tub. A first recess of the second tub may be defined to project downward from a rear portion of a lower surface of the second tub and is configured to heat wash water in the second tub. A metal plate member may be provided on an outside of the lower surface of the second tub and may be configured to reinforce the second tub, the metal plate member configured to partially extend towards the rear portion of the lower surface of the second tub and to expose a bottom surface of the first recess of the second tub.

In some implementations, the second tub may be made of plastic.

In some implementations, the metal plate member may be affixed to the lower surface of the second tub.

In some implementations, the metal plate member may be affixed directly to the lower surface of the second tub.

In some implementations, a first portion of the metal plate member may be integrally formed in the lower surface of the second tub.

In some implementations, the first portion of the metal plate member that is integrally formed in the lower surface of the second tub may be a center portion of the metal plate member that is injection-molded into the lower surface of the second tub.

In some implementations, the metal plate member may be configured to partially extend towards the rear portion of the lower surface of the second tub and to expose the bottom surface of the first recess of the second tub by extending further towards a front of the second tub rather than a rear of the second tub where the first recess is provided.

In some implementations, the laundry machine may further include a cabinet defining an exterior of the laundry machine. The first washing unit and the second washing unit may be provided in the cabinet.

In some implementations, the first recess may be a first portion of an interior space of the second tub that projects further in a downward direction as compared to a second portion of the interior space of the second tub.

In some implementations, the first recess may be formed in an outer radial portion of the second tub in a radial direction of the motor of the second drive unit.

In some implementations, relative to a center of the second tub, a first area of the lower surface of the second tub that is covered by the metal plate member that extends from the center of the second tub to a front of the second tub may be larger than a second area of the lower surface of the second tub that is covered by the metal plate member that extends from the center of the second tub to a rear of the second tub.

In some implementations, the metal plate member may be provided between the lower surface of the second tub and the motor of the second drive unit.

In some implementations, a first portion of the metal plate member may be provided to surround the motor of the second drive unit, and the metal plate member may be configured to transfer heat from the first portion surrounding the motor downward to an outside of the laundry machine.

In some implementations, a first portion of a drying duct that is provided in the first washing unit may be provided in a space formed between a lower portion of the second washing unit and an upper portion of the first washing unit, and the metal plate member may be configured to vertically overlay at least a portion of the drying duct.

In some implementations, the metal plate member may include a stepped portion that is molded to the lower surface of the second tub.

In some implementations, the motor of the second drive unit may include a stator directly mounted to a lower back surface of the second tub; and a rotor provided to surround the stator. A bottom surface of the first recess may be located at a height that is lower than a lowermost portion of the motor of the second drive unit.

In some implementations, the motor of the second drive unit may include: a stator mounted to a lower back surface of the second tub via the metal plate member; and a rotor provided to surround the stator. The bottom surface of the first recess may be located at a height that is lower than a lowermost portion of the motor of the second drive unit.

In some implementations, the motor of the second drive unit may include a stator; and a rotor provided to surround the stator. The metal plate member may include an inclined portion formed to surround the rotor, the inclined portion formed over the rotor and inclined downward in an outward radial direction.

In some implementations, the first rotational shaft of the first washing unit may be perpendicular to the second rotational shaft of the second washing unit.

In some implementations, the first recess of the second tub may be configured to heat the wash water in the second tub by heating at least one surface of the second tub that defines the first recess.

Further scope of applicability of the present disclosure will become apparent from the detailed description given hereinafter. However, it should be understood that the detailed description and specific examples are given by way of illustration only, and various changes and modifications within the spirit and scope of the disclosure may be made.

DETAILED DESCRIPTION

Figure 1:
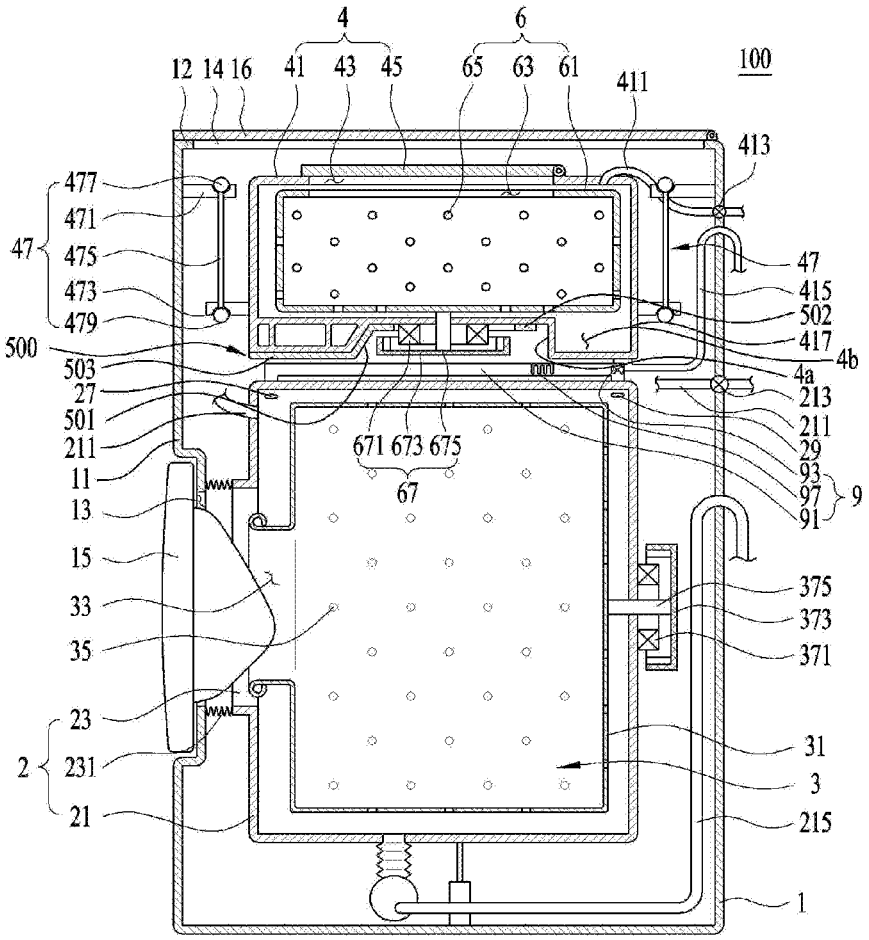
FIGS. 1 and 2 are diagrams illustrating examples of cross-sectional views of a laundry machine in accordance with the present disclosure.

Implementations disclosed herein provide a laundry machine, which may be referred to as a twin laundry machine, that includes two different laundry treating devices. The two laundry treating devices may be configured to facilitate loading and unloading of laundry. For example, in some implementations, the laundry machine may be configured with reduced overall height in providing the two different treating devices, thus improving convenience of using both devices.

Implementations of the present disclosure may also provide a laundry machine that reduces the transfer of vibrations, interference, and heat between the two different treating devices. Thus, in implementations in which the two laundry treating devices are provided in a single cabinet, implementations of the present disclosure may enable a laundry machine with improved reliability and durability in a compact overall size.

In some implementations, the laundry machine may include first and second washing units. The first washing unit includes a first tub, a first drum, and a first drive unit for driving the first drum, and the second washing unit includes a second tub, a second drum, and a second drive unit for driving the second drum. The second washing unit may be arranged on a top of the first washing unit and may have a smaller laundry treating capacity than the first washing unit. The second drum may have a diameter larger than its height, and may also have a shaft that is angled (e.g., perpendicular) relative to a shaft of the first drum. The second drive unit may include a motor connected to the shaft of the second drum in an outer lower portion of the second tub. The motor may include a stator mounted to the lower back surface of the tub; and a rotor surrounding the stator.

A plate member may be provided between the motor and an outer surface of the second tub. This plate member may be configured to shield off and reduce heat that is generated in the motor from being transferred to the second tub. The plate member may thus be arranged outside the second tub and configured to reinforce and protect the second tub.

The plate member may be fixed to an outer surface of the second tub. For example, the plate member may be attached to the outer surface of the second tub in a close proximity. In some scenarios, a predetermined portion of the plate member may be inserted in the second tub when injection-molding the second tub, and may be integrally formed with the second tub. The plate member may be metallic, in some implementations.

The second washing unit may be arranged on a top of the first washing unit. In some implementations, the laundry treating capacity of the first washing unit may be larger than that of the second washing unit.

The cabinet may be a single cabinet defining an exterior of the laundry machine, and the first washing unit and the second washing unit may be provided in the single cabinet. As such, the laundry machine may include two washing units which are mounted in the single cabinet.

A predetermined portion of a drying duct may be provided in between a bottom surface of the second washing unit and a top surface of the first washing unit, and the metal plate member may be vertically overlapped with the drying duct.

The plate member may be provided in a lower back surface of the second tub. In some scenarios, a predetermined portion of the plate member may be provided to surround the motor and the heat which rises in the motor may be guided downward to a radiation direction via the plate member to be exhausted outside.

A recess may be formed in the second tub and may be configured to heat wash water. For example, the recess may be formed in an outer portion of the second tub in a radial direction of the motor. The plate member may be configured so as not to cover the recess. For example, the recess may be provided in a rear portion of the second tub, and the plate member may be configured to extend further towards a front portion of the second tub, and not extend fully to the rear portion where the recess is located.

The temperature of the drying duct may be higher in a front portion than in a rear portion, so that the heat exchange between the drying duct and the second tub may be reduced by the plate member.

The plate member may include a stepped portion to be molded to the lower back surface of the second tub, so as to improve the strength and securing strength. In some implementations, the second tub may be made of plastic and the plate member may be made of metal. For example, the plate member may be formed by aluminum die casting.

A heat radiation shut-off film may be provided in a surface of the plate member so as to prevent the radiation heat from being absorbed in the plate member. Accordingly, the more effective heat radiation function can be expected.

Implementations of the present disclosure also provide a laundry machine including a first washing unit including a first tub, a first drum and a first drive unit for driving the first drum; and a second washing unit including a second tub, a second drum and a second drive unit for driving the second drum, the second washing unit arranged on a top of the first washing unit and having a smaller laundry treating capacity than the first washing unit, the laundry machine wherein the second drum has a diameter which is larger than the height and a shaft which intersects a shaft of the first drum, and the second drive unit includes a motor connected to the shaft of the second drum in an outer lower portion of the second tub, and a recess is formed from a lower outer surface of the second tub to an outer portion in a radial direction of the motor to be connected to a drainage pump and the recess is more projected downward than the other portion, and a plate member if provided between the motor and the lower outer surface of the tub and guiding the heat rising in the motor in a heat radiation direction downward to be exhausted outside.

The plate member may include a metal plate secured to the lower outer surface of the second tub. The plate member may include an inclined portion formed to surround the rotor, over the rotor, and inclined downward in an outer portion in a radial direction.

The lower outer surface of the recess may be vertically located lower than a lower outer surface of the motor. The plate member may be provided in the lower outer surface of the second tub, and may be configured so as not to cover the lower outer surface of the second tub where the recess is located. For example, the recess may be located in a rear portion of the second tub, and the plate member may extend toward a front portion of the second tub, opposite from the recess, and not extend fully to the rear portion of the second tub where the recess is located.

Implementations of the present disclosure also provide a laundry machine including a cabinet including a first opening provided in a front surface and a second opening provided in an upper surface; a first tub provided in the cabinet and defining a predetermined space for storing water, in communication with the first opening; a first drum rotatably mounted in the first tub and defining a predetermined space for storing clothes, in communication with the first opening; a second tub provided in the cabinet, over the first tub, and defining a predetermined space for storing clothes, in communication with the second opening; a second drum rotatably mounted in the second tub and defining a predetermined space for storing clothes, in communication with the second opening; and a hot air supply unit provided in the cabinet and supplying heated air to the first tub or the second tub, located in a space formed between a bottom surface of the second tub and the first tub.

Implementations of the present disclosure also provide a laundry machine including a first washing unit including a first tub, a first drum and a first drive unit for driving the first drum; and a second washing unit including a second tub, a second drum and a second drive unit for driving the second drum, the second washing unit arranged on a top of the first washing unit and having a smaller laundry treating capacity than the first washing unit, wherein the second drum has a diameter which is larger than the height and a shaft which intersects a shaft of the first drum, and the second drive unit includes a motor connected to the shaft of the second drum in an outer lower portion of the second tub, and a recess projected downward is formed in a lower back surface of the second tub to heat wash water, and a metal plate member is provided in a rear surface of the second tub to reinforce the strength of the second tub, except a rear surface of the recess.

The second tub may be made of plastic. The metal plate member may be fixed to a rear surface of the second tub. The metal plate member may be attached to the rear surface of the second tub closely. A predetermined portion of the metal plate member may be inserted in the second tub when injection-molding the second tub and integrally formed with the second tub.

The cabinet may be a single cabinet defining an exterior of the laundry machine, and the first washing unit and the second washing unit may be provided in the single cabinet.

The recess may be formed in an outer portion in a radial direction of the motor. The area of the second tub covered by the metal plate member may be larger in the opposite portion to the recess than the portion near the recess with respect to the center of the second tub. The metal plate member may be provided between the rear surface of the second tub and the motor. A predetermined portion of the metal plate member may be provided to surround the motor and the heat which rises in the motor is guided downward to a radiation direction via the metal plate member to be exhausted outside.

A predetermined portion of a drying duct provided in the first washing unit may be provided in a space formed between a lower portion of the second washing unit and an upper portion of the first washing unit, and the metal plate member may be vertically overlapped with the drying duct.

The metal plate member may include a stepped portion to be molded to the lower back surface of the second tub.

The motor may include a stator directly mounted to a lower back surface of the tub; and a rotor provided to surround the stator, and the lowermost portion of the recess is located lower than the lowermost portion of the motor. In some implementations, the motor may include a stator mounted to a lower back surface of the tub via the metal plate member; and a rotor provided to surround the stator, and the lowermost portion of the recess may be located lower than the lowermost portion of the motor.

The motor may include a stator; and a rotor provided to surround the stator, and the metal plate member includes an inclined portion formed to surround the rotor, over the rotor, and inclined downward in an outer portion in a radial direction.

Some examples of implementations will be described below in more detail with reference to the accompanying drawings.

Referring to FIG. 1, a laundry machine 100 includes a cabinet 1. The cabinet 1 includes a first laundry treating device, which includes a first tub 2 and a first drum 3, defining a predetermined space in which washing of drying for clothes can be performed. The cabinet 1 also includes a second laundry treating device, which includes a second tub 4 and a second drum 6, defining a predetermined space in which washing or drying for clothes can be performed. The second laundry treating device is arranged above the first laundry treating device. For example, the first laundry treating device may be a first washing unit and the second laundry treating device may be a second washing unit.

The cabinet 1 defines an exterior of the laundry machine and includes a bottom surface supported by the ground; an upper surface 12 arranged over the bottom surface; and a lateral surface connecting the upper surface and the bottom surface with each other. The lateral surface may consist of a front surface 11 arranged in a front of the laundry machine and a rear surface arranged in a backside of the laundry machine.

A first opening 13 is provided in the front surface 11 to communicate with the first laundry treating device (first tub 2 and first drum 3) and a second opening 14 is provided in the upper surface 12 to communicate with the second laundry treating device (second tub 4 and second drum 6). An external air inlet hole 19 is provided in the rear surface of the cabinet 1 to draw external air into the cabinet 1.

The first opening 13 is open or closed by a first door 15 rotatably coupled to the front surface 11 and the second opening 14 is open or closed by a second door 16 rotatably coupled to the upper surface 12.

In some implementations, the first door 15 may be configured to open and close the first opening 13 and a first tub opening 23 of the first laundry treating device. The second door 16 may be provided to open and close only the second opening 14.

The first laundry treating device includes a first tub 2 provided in the cabinet 1 and in communication with the first opening 13; and a first drum 3 rotatably mounted in the first tub 2 and providing a predetermined space for storing clothes or laundry.

The first tub 2 may be formed in any suitable shape that holds water. FIG. 1 illustrates the first tub 2 which is formed in a cylindrical shape as one example.

In this instance, the first tub 2 includes a first tub body 21 formed in a hollow cylinder shape; and a first tub opening 23 penetrating a front surface of the first tub body and in communication with the first opening 13.

The first tub body 21 is fixed in the cabinet 1 by a first tub support unit 251, 253 and 255, which will be described in detail later.

The first opening 13 and the first tub opening 23 are connected by a gasket 231. The gasket 231 may be formed of an elastic material such as rubber to prevent the leakage of water from the first tub body 21 and the transferring of vibration from the first tub body 21 to the cabinet 1.

The first drum 3 may be provided in any suitable shape configured to rotate within the first tub body 21. FIG. 1 illustrates the first drum formed in a cylindrical shape as one example.

In this instance, the first drum 3 may include a first drum body 31 formed in a hollow cylindrical shape; a first drum opening 33 penetrating a front surface of the first drum body and in communication with the first tub opening 23; and a plurality of penetrating holes 35 penetrating the first drum body 31 to make an internal space of the first drum body communicate with an internal space of the first tub body.

The first drum opening 33 communicates with the first opening 13 via the first tub opening 23. When the first door 15 opens the first opening 13, the user is able to load clothes into the first drum body 31 or unload the clothes held in the first drum body 31 via the first opening 13, the first tub opening 23 and the first drum opening 33.

The first drum body 31 is rotatable by a first drive unit. As one example, FIG. 1 illustrates the first drive unit including a first stator 371 fixed to a rear surface of the first tub body 21 and forming a rotating field; a first rotor 373 rotatable by the rotating field; and a first shaft 375 connecting the first drum body 31 to the first rotor 373 through the rear surface of the first tub body.

The first shaft 375 may be provided in parallel with the bottom surface of the cabinet (or to form an angle smaller than a threshold angle with respect to the bottom surface of the cabinet) and to form zero or more degree angle with respect to the bottom surface of the cabinet 1.

In the latter case, the first shaft 375 has to be provided to have a smaller angle than 90 degrees with respect to the bottom surface of the cabinet. The second laundry treating device (second tub 4 and second drum 6) is located on the top of the first laundry treating device (first tub 2 and first drum 3) and the first drum opening 33 is located in the front surface of the first drum body 31 so that the tilt angle of the first shaft 375 has to be 90 degrees or more with respect to the bottom of the cabinet and that the user can unload the clothes held in the first drum body 31 out of the cabinet.

The first laundry treating device (first tub 2 and first drum 3) having the structure mentioned above may receive water via a first water supply unit and may drain the water out of the cabinet via a first drainage unit. The first water supply unit may include a first water supply pipe 211 connecting the first tub body 21 to an external water supply source arranged outside the cabinet; and a first valve 213 for opening or closing the first water supply pipe 211 according to a control signal of at least one processor, such as a controller.

In some implementations, the first drainage unit may include a first drainage pipe 215 for guiding the water held in the first tub body toward the outside of the cabinet 1; and a first pump 217 for moving the water held in the first tub body along the first drainage pipe 215.

The first drainage pipe 215 may be provided to pass a higher point than the highest water level set in the first tub body 21. In some scenarios, this configuration may facilitate the water storing in the first tub body 21, even without an auxiliary valve for opening and closing the first drainage pipe.

The second laundry treating device includes a second tub 4 provided beyond the first tub body 21 and defining a predetermined space for storing water, in communication with the second opening 14; and a second drum 6 rotatably mounted in the second tub 4 and defining a predetermined space for storing clothes.

The second tub 4 may be formed in any suitable shape configured to provide a space for storing water and FIG. 1 illustrates the second tub 4 formed in a cylindrical shape as one example.

In this instance, the second tub 4 may include a second tub body 41 provided in a hollow cylinder shape and located beyond the first tub body 21; and a second tub opening 43 penetrating an upper surface of the second tub body 41 and in communication with the second opening 14.

The second tub body 41 is fixed in the cabinet 1 by a second tub supporting unit 47. The implementation of the laundry machine may include at least three second tub supporting unit 47 which are spaced a distance apart from each other along a circumferential surface of the second tub body 41.

The second tub supporting unit may include a support bar 475 having one end rotatably coupled to the cabinet 1 and the other end rotatably coupled to the second tub body 41.

More specifically, the second tub supporting unit 47 may include a first bracket 471 provided in the cabinet 1 and rotatably supporting an upper end of the support bar; and a second bracket 473 provided in the second tub body 41 and rotatably supported to a lower end of the support bar 475. In this instance, a first coupling portion 477 is provided in the upper end of the support bar 475 to be rotatably supported to the first bracket 471. A second coupling portion 479 is provided in a lower end of the support bar 475 to rotatably support the second bracket 473. FIG. 1 illustrates the first coupling portion 477 and the second coupling portion 479 which are formed in a sphere shape as one example.

The second tub opening 43 may be open or closed by a second tub door 45 rotatably coupled to the upper surface of the second tub body 41. The second tub door 45 is exposed outside the cabinet via the second opening 14, when the second door 16 opens the second opening 14.

The second tub door 45 may be located in a projected plane of the second opening 14 which is formed on the upper surface of the second tub body 41 to rotate toward outside the cabinet 1 via the second opening 14 when the second door 16 opens the second opening 14.

The second drum 6 may be formed in any shapes only if provided in a shape rotatable in the second tub body 41 FIG. 1 illustrates the second drum 6 formed in a cylinder shape as one example.

In this instance, the second drum 6 may include a second drum body 61 located in the second tub body 41 and formed in a cylinder shape; a second drum opening 63 penetrating an upper surface of the second drum body and in communication with the second tub opening 43; and a plurality of penetrating holes 65 penetrating the second drum body and make an internal space of the second drum body 61 communicate with an internal space of the second tub body 41.

The second drum opening 63 is located under the second tub opening 43. When the user opens the second opening 14 by using the second door 16 and the second tub opening 43 by using the second tub door 45, the second drum opening 63 is exposed outside the upper surface 12 of the cabinet. Accordingly, the user is able to load or unload clothes into or out of the second drum body 61 via the second opening 14.

The second drum body 61 is rotatable by a second drive unit 67. The second drive unit may include a second stator 671 fixed to a bottom surface of the second tub body 41 and forming a rotating field; a second rotor 673 rotatable by the rotating field; and a second shaft 675 connecting the second drum body 61 to the second rotor 673 through the bottom surface of the second tub body 41.

The second shaft 675 may be provided to lie at right angles to the bottom surface of the cabinet 1. The second drum opening 63 provided in the second drum body 61 is exposed outside via the upper surface 12 of the cabinet so that the second shaft 675 may be set to be arranged at an angle larger than zero and smaller than 90 degrees.

The second laundry treating device (second tub 4 and second drum 6) having the structure mentioned above supplies water to the second tub body 41 via a second water supply unit and drains the water stored in the second tub body 41 via a second drainage unit.

The second water supply unit may include a second water supply pipe 411 connecting the second tub body 41 to a water supply source; and a second valve 413 opening and closing the second water supply pipe according to a control signal of the controller.

The second drainage unit may include a second drainage pipe 415 guiding the water stored in the second tub body 41 toward the outside of the cabinet 1 and provided to pass a higher point than the maximum water level preset in the second tub body 41; and a second pump 417 for moving the water along the second drainage pipe.

Moreover, the implementation of the laundry machine 100 further include a hot air supply unit 9 for supplying heated air to the first tub body 21 or the second tub body 41. FIG. 1 illustrates the hot air supply unit 9 for supplying heated air to the first tub body 21 as one example.

The hot air supply unit 9 provided in the illustrated implementation may include a duct 91 providing a passage for exhausting internal air of the first tub body 21 outside the first tub body 21 and re-supplying the air to the first tub body 21; a fan 93 circulating the internal air of the first tub body 21 through the duct 91; and a heater 97 for heating the air drawn into the duct 91.

One end of the duct 91 is connected to a first tub penetrating hole 27 penetrating the first tub body and the other end is connected to a second tub penetrating hole 29 penetrating the first tub body. The first tub penetrating hole 27 is configured to draw in the air having passed the heater into the first tub body 21 and the second tub penetrating hole 29 is configured to exhaust the internal air of the first tub body 21 to the duct 91.

A cooling unit may be further provided in the duct 91 to remove the moisture contained in the air (e.g., dehydrating the air) by cooling the air moving toward the heater 97. The cooling unit may be one example of a cold water supply unit for using an inner circumferential surface of the first tub body as space for air condensing by supplying cold water to the inner circumferential surface. In this instance, no condensing duct has to be provided advantageously.

The second laundry treating device (second tub 4 and second drum 6) of the implementation is located on the top of the first laundry treating device (first tub 2 and first drum 3). The higher the second laundry treating device is located, the more difficult it is for the user to load or unload clothes into or from the second laundry treating device. Accordingly, it is very important to adjust the heights of the second opening 14, the second tub opening 43 and the second drum opening 63 in the laundry machine having the top second laundry treating device (second tub 4 and second drum 6) and the bottom first laundry treating device (first tub 2 and first drum 3).

Figure 2:
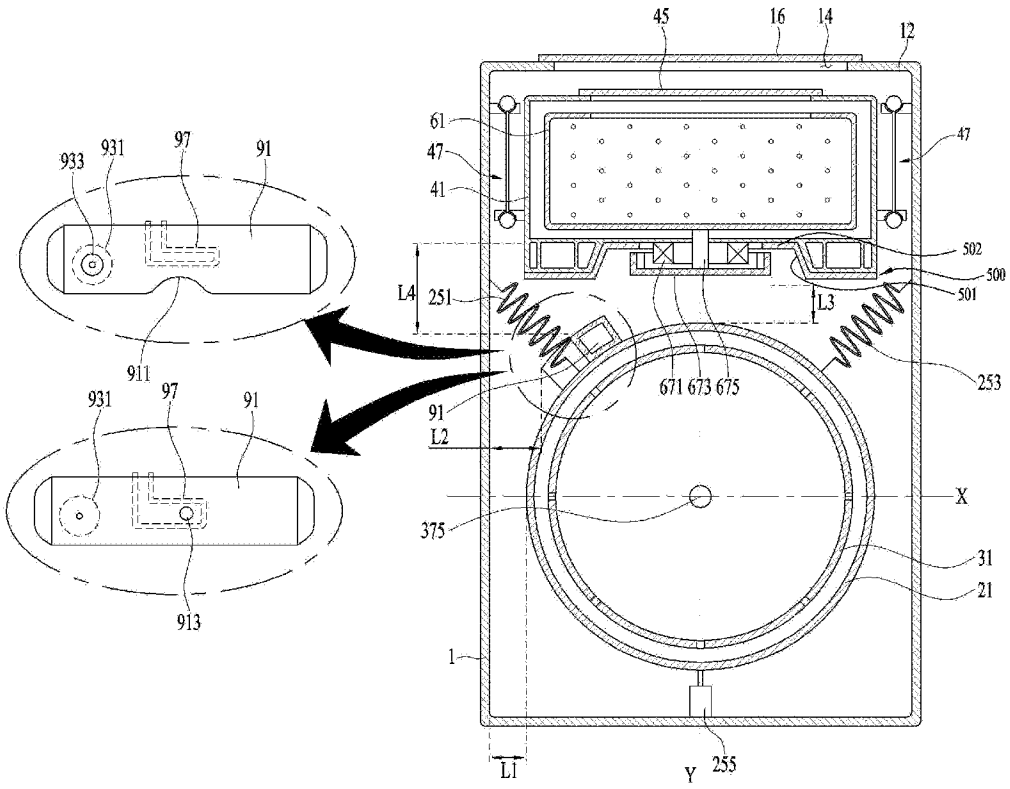

To minimize the height of the cabinet, the duct 91 shown in FIG. 2 may be fixed to the first tub body 21 to be located between an upper region of a circumferential surface of the first tub body 21 and the bottom surface of the second tub body 41. The upper region of the circumferential surface of the first tub body 21 refers to the region located beyond a horizontal line (X, as horizontal line passing the rotation center of the first drum body) passing the center of the first tub body in the space defined by the first tub body 21.

In some implementations, as mentioned above, the first tub body 21 is fixed in the cabinet 1 by the first tub supporting unit.

The first tub supporting unit may include a first spring for fixing the upper region of the circumferential surface of the first tub body 21 to the cabinet 1; a second spring for fixing the upper region of the circumferential surface to the cabinet 1; and a damper 255 for fixing a lower region of the circumferential surface to the cabinet 1.

The damper 255 may be configured to dampen the vibration of the first tub body 21. The first and second springs 251 and 253 may be configured to provide restitution to the first tub body 21 as well as dampening the vibration.

The damper 255 may be used in fixing the lower region of the circumferential surface of the first tub body 21 to the bottom surface or the lateral surface of the cabinet 1.

The first spring 251 and the second spring 253 may be arranged in symmetry with each other with respect to a vertical line (Y as vertical line passing the rotation center of the first drum body) passing the center of the first tub body 21.

When the first tub supporting unit of the present disclosure is provided with the structure mentioned above, the first spring 251 or the second spring 253 is likely to interfere with the duct 91. Accordingly, the duct 91 may include a bending groove 911 for preventing the interference of the first or second spring 251 or 253 with the duct 91.

The bending groove 911 is formed by concavely bending one surface of the duct 91 and the duct penetrating hole 913 penetrates the duct 91 to connect the first or second spring 251 or 253 to the first tub body 21 via the duct 91.

Figure 3:
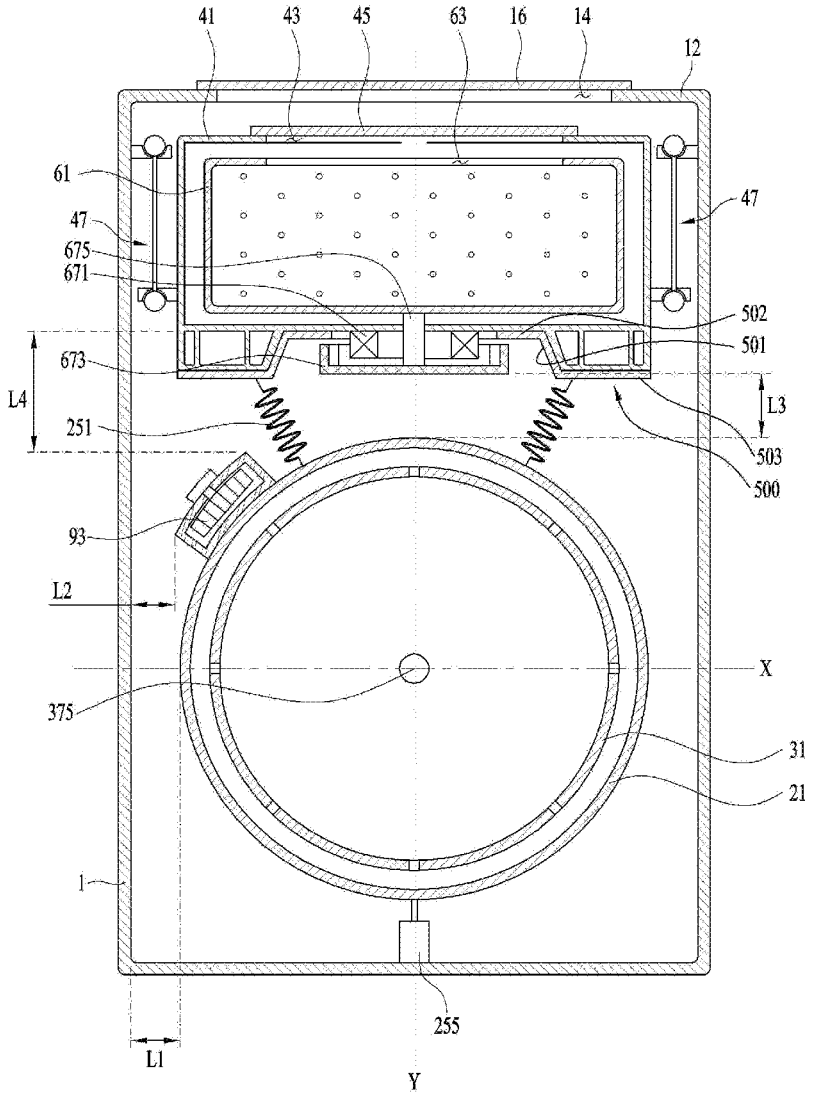
FIG. 3 is a diagram illustrating another example of a laundry machine.

In some implementations, it is more advantageous to the first spring 251 and the second spring 253 to provide elasticity to the first tub body 21, as they are arranged more perpendicular with respect to the bottom surface of the cabinet 1. Accordingly, the first spring 251 and the second spring 253 may be provided as shown in FIG. 3.

More specifically, the first spring 251 may be provided to connect the upper region of the circumferential surface of the first tub body 21 to the bottom surface of the second tub body 41 and the second spring 253 may be provided to connect the upper region of the circumferential surface to the bottom surface of the second tub body 41.

The implementation of the laundry machine 100 above may include the top second laundry treating device (second tub 4 and second drum 6) and the bottom first laundry treating device (first tub 2 and first drum 3), and may be configured to prevent the first tub body 21 from interfering with the second tub body 41. For example, the laundry machine 100 may be configured to prevent the vibration generated in the first tub body 21 in the operation of the first laundry treating device from being transferred to the second tub body 41 or the vibration generated in the second tub body 41 in the operation of the second laundry treating device from being transferred to the first tub body 21.

As such, in some implementations the shortest distance (L4) between the duct 91 and the second tub body 41 is formed to be more than the shortest distance (L1) between the first tub body 21 and the cabinet 1.

The shortest distance (L1) between the first tub body 21 and the cabinet 1 is designed, considering the vibrating amplitude of the first tub body 21. When the shortest distance (14) between the duct and the second tub body 41 is set as more than the shortest distance (L1) between the first tub body and the cabinet, the risk of transferring the vibration generated in the first tub body 21 to the second tub body 41 may be minimized.

Moreover, when the shortest (L4) between the duct 91 and the second tub body 41 is set as more than twice the shortest distance (L1) between the first tub body 21 and the cabinet 1, the risk may be effectively prevented that the vibration generated in the first tub body 21 is transferred to the second tub body 41.

The vibration generated in the first tub body 21 might be transferred to the second tub body 41 via the second drive unit 67, so that the shortest distance (L3) between the second rotor 673 of the second drive unit and the first tub body 21 may be set to be equal to or more than twice the shortest distance (L1) between the cabinet and the first tub body 21.

In some implementations, the shortest distance (L2) between the duct 91 and the cabinet 1 may be set as more than the shortest distance (L1) between the first tub body 21 and the cabinet 1, to prevent the vibration generated in the first tub body 21 from being transferred to the cabinet 1 via the duct 91.

Figure 4:
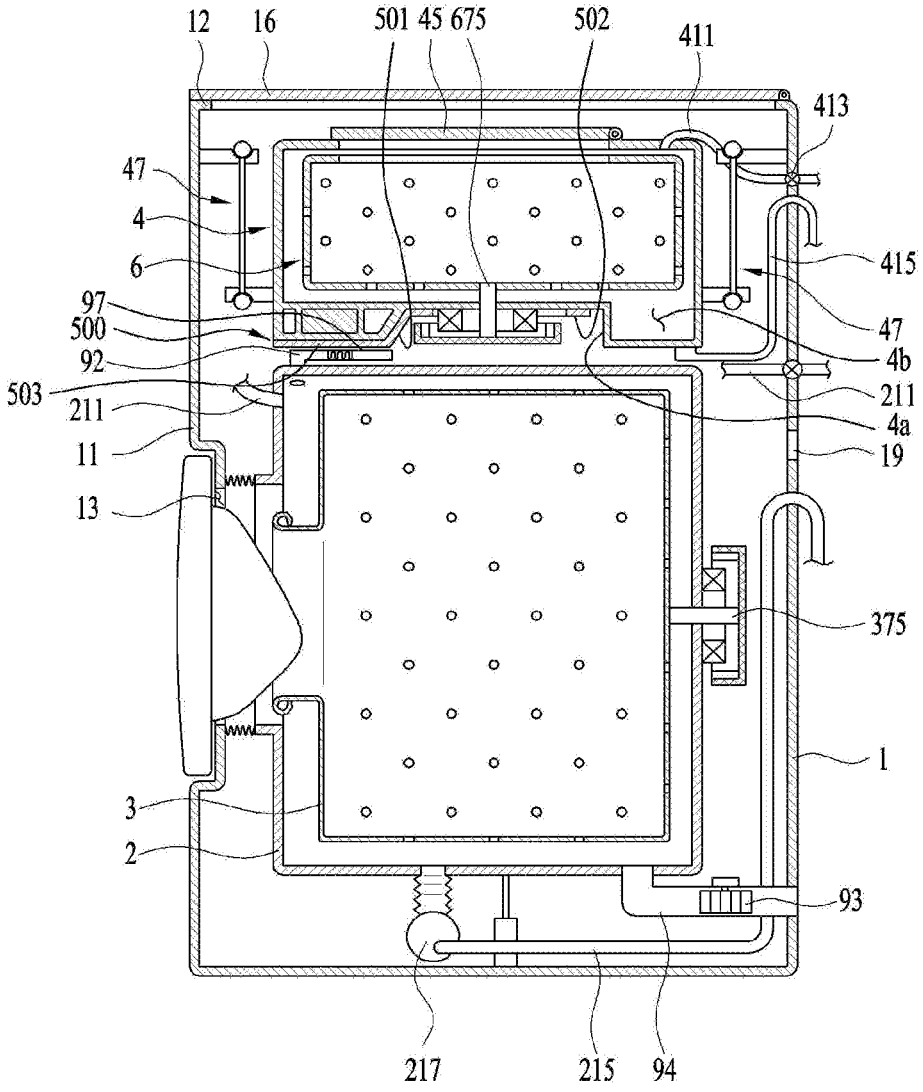
FIG. 4 is a diagram illustrating another example of a laundry machine.

FIG. 4 illustrates another implementation of the laundry machine 100. The illustrated implementation of the laundry machine 100 is characterized in that the hot air supply unit 9 includes a supply duct 92 for supplying external air to the first tub body 21; an exhaustion duct 94 for exhausting internal air of the first tub body 21 outside the cabinet 1; a fan 93 provided in the exhaustion duct 94; and a heater 97 for heating the air drawn into the supply duct 92.

In this instance, the supply duct 92 may be located between the upper region of the circumferential surface of the first tub body 21 and the bottom surface of the second tub body 41. The exhaustion duct 94 may be provided in the space formed between the cabinet 1 and the lower region of the circumferential surface of the first tub body 21 or a space formed between the upper region of the circumferential surface of the first tub body 21 and the bottom surface of the second tub body 41.

Accordingly, when the fan 93 rotates, some of the air drawn into the cabinet via an external air inlet hole 19 is drawn into the first tub body 21 via the supply duct 92. In that process, the air is heated by the heater 97.

When the air heated via the supply duct 92 is drawn into the first tub body 21, the internal air of the first tub body 21 is exhausted outside the cabinet 1 via the exhaustion duct 94 by the pressure inside the first tub body 21 so as to facilitate the drying of the clothes.

The implementations are described on a basis for the hot air supply unit 9 supplying heated air to the first tub body 21. Alternatively, the hot air supply unit 9 may supply heated air to the second tub body 41.

In this instance, the duct 91 has to be provided to circulate the internal air of the second tub body 41 and the supply duct 92 has to be provided to supply external air to the second tub body 41. In some implementations, the exhaustion duct 94 may be arranged in the space formed between the upper region of the circumferential surface of the first tub body 21 and the bottom surface of the second tub body 41 and exhaust the internal air of the second tub body 41 outside the cabinet.

Hereinafter, implementations applicable to the present implementation will be described in detail, in an aspect of the hot air supply unit 9.

As shown in FIG. 1, two washing units may be provided in on cabinet 1.

In this example, a second tub 4 is provided beyond a first tub 2 and a second drive unit 67 is provided underneath a lower back surface of the second tub 4. The second drive unit 67 includes a rotary second rotor 673. Accordingly, a vertical space is formed between the two washing units and it is limited to increase such a space vertically. When both gaps are increased, the overall height of the cabinet is increased by a wide margin, and the increased overall height of the cabinet may make it difficult for a user to use the second washing unit.

Therefore, in some scenarios, there may be challenges in excluding the interference between the two washing units in such the narrow space. For example, wires or tubes may be arranged such the space, making it difficult to exclude the interference between such components and the second rotor 673.

In some scenarios, there may be a risk of overheating the second stator 671 of the second drive unit 67. For example, as the motor is driven, the temperature of the second stator 671 may rise. In such scenarios, it may be desirable to radiate the heat generated in the second stator 671 effectively.

In addition, such the narrow space makes it no easy to reduce the heights of the second tub 4 and the second drum 6, because the laundry treating capacity could be remarkably reduced by decreasing the heights. It is possible to increase the capacity by enlarging a diameter more than the heights of the second tub 4 and the second drum 6 but it is limited by the size of the cabinet to increase the diameter.

To solve such disadvantages, the illustrated implementation illustrates that the lower back surface of the second tub 4 is projected upward. In other words, the lower back surface of the second tub 4 is recessed inward to the second tub 4. Corresponding to such the shape of the second tub 4, the shape of the second drum 6 may have a recessed portion inward to the second drum 6.

Such different recessed portions may be provided in central portions of the second tub 4 and the second drum 6, respectively. The second drive unit 67 may be provided in the center in which the recess is formed.

The lowermost portion of the second drive unit 67 is located higher than the lowermost portion of the second tub 4. Especially, the lowermost portion of the rotary second rotor 763 may be located higher than the lowermost portion of the second tub 4 so that the second rotor 673 may rotate in a state of being surrounded by the second tub 4. Even when the second rotor 673 is driven, the interference of the rotor with the other components located under the second tub 4 can be excluded. Even when a narrow space is provided between the first washing unit and the second washing unit, it is possible to use the washing units.

In some implementations, as the second drive unit 67 is provided in the narrow space, the heat generated in the second drive unit 67, especially, the second stator 671 might fail to be radiated only to be transferred to the second tub 4. As mentioned above, it is limited in reducing the height of the second tub 4 so that the lower thickness of the second tub 4 is relatively small.

The second tub 4 is formed of plastic and the second tub 4 made of plastic becomes more susceptible to heat as the lower thickness gets smaller. Also, the structural strength becomes reduced. Such the lower portion of the second tub 4 is the portion where the second drive unit 67 is mounted only to cause damage to the second tub 4 which is likely to deteriorate the strength.

Accordingly, heat damage prevention and strength reinforcement are required.

The illustrated implementation of the laundry machine may include a plate member 500 provided between the second drive unit 67, in other words, a motor and an outer surface of the second tub 4. The plate member 500 provided between the outer surface of the second tub 4 and the second stator 671 may facilitate smooth flow of heat in a radial direction.

The plate member 500 may be fixed to the outer surface of the second tub 4 or closely attached to the outer surface of the second tub 4.

The second drum 6 is rotatable on a vertical shape and the outer surface where the plate member 500 is provided may be a lower back surface of the second tub 4.

A portion of the plate member 500 may be inserted in the second tub 4 when injection-molding the second tub 4, so that the portion of plate member 500 is integrally formed with the second tub 4. For example, a center portion of the plate member 500 may be integrally formed with the second tub 4, for example by inserting the center portion of the plate member 500 into the surface of second tub 4 during injection-molding of the second tub 4.

In some implementations, the second shaft 675 of the second drive unit 67 penetrates the center of the second tub 4 and a bearing is provided to rotatably support the second shaft 675. The bearing may be provided as a bearing housing. The center of the plate member 500 may be formed in a shape of a bearing housing.

In some implementations, as mentioned above, a drying duct 91 may be formed between the first washing unit and the second washing unit. The drying duct 91 may be connected to a front portion from a rear portion of the first tub 2.

A heater 97 of the drying duct 91 may be configured to heat the air that is exhausted from the first tub 2 and re-supply the heated air into the first tub 2. Accordingly, the temperature of the front portion may be higher than that of the rear portion in the drying duct 91. For example, the amount of the evaporated moisture may be relatively small in an initial stage of the drying, and the temperature may be higher in the front portion than the rear portion of the drying duct 91.

Accordingly, in such scenarios, high temperatures of the drying duct 91 are likely to affect the lower back surface of the second tub 4. For example, the heat is likely to be transferred to the lower back surface, especially, a front portion of the lower back surface of the second tub 4.

In some implementations, the plate member 500 is vertically overlapped with the drying duct 91. For example, the plate member 500 may be provided in the front portion of the lower back surface of the second tub 4.

As such, the plate member 500 may be not arranged in an entire portion of the lower back surface uniformly but instead may occupy a larger area of the front portion of the lower back surface in the second tub 4. Accordingly, the plate member 500 may function to partition off the drying duct 91 from the second tub 4 so that heat transfer between the drying duct 91 and the second tub 4 may be reduced.

In some implementations, at least predetermined portion of the plate member 500 may be formed to cover the second stator 671 and the second rotor 673. The heat rising in the second rotor 673 may be guided downward in a radial direction to be exhausted outside.

For that, an inclined portion 501 may be formed in the plate member 500. The inclined portion 501 may be inclined downward from a center to a radial direction. Accordingly, heat may be guided along the inclined portion 501 radially and downward to be exhausted outside.

As a result, the heat inside the second rotor 673 may be exhausted easily so that cold air outside the second rotor 673 can be drawn into the second rotor smoothly enough to radiate the second stator 671. As such, the plate member 500 may function to guide air flow as well as to mitigate heat transfer.

In some implementations, a downwardly recessed space, such as recess **4*b*, is formed in the second tub 4. The recess 4*b* may be connected to the second pump 417 and may correspond to the lowermost space where wash water is held in the second tub 4**.

In some implementations, the recess **4*b* may be configured to heat wash water. For example, a heater for heating wash water may be configured as part of the recess 4*b* so as to form a heating space. As such, water that is held in the second tub 4 may be heated in the recess 4*b***.

The recess **4*b* may be downwardly recessed from the lower back surface of the second tub 4, so that it may correspond to the lowermost portion of the second tub 4. When the second drive unit is mounted such a portion, the overall height of the second tub 4 may be increased. Accordingly, in some implementations, the recess 4*b*** is partitioned off from the space where the second drive unit is mounted.

As an example, a recess **4*a* projected upward may be formed in the center of the second tub 4 and the recess 4*b* may be formed in an outer portion along a radial direction of the recess 4*a*. Accordingly, the lowermost portion of the recess 4*b* may be lower than the lowermost portion of the second rotor 673. For example, the recess 4*b* may be provided to cover at least predetermined portion of the second rotor 673 by using the recess 4*a***.

In some implementations, the plate member 500 may be configured so as not to cover the lower back surface of the second tub 4 corresponding to the lower portion of the recess **4*b*. As such, the plate member 500 may be configured so as not to cover the recess 4*b*. In such implementations, the recess 4*b* may be located in a rear portion of the second tub 4. Wash water may be exhausted via the recess 4*b*** and the length of the drainage pipe line may be reduced.

In some implementations, the plate member 500 may not be formed in an entire portion of the lower back surface of the second tub 4. For example, the plate member 500 may extend to the front portion of the second tub 4, but may not fully extend to a rear portion of the lower back surface of the second tub 4. As a specific example, the plate member 500 may include an expanded portion 503 expanded from the center toward the front portion of the second tub 4 in an opposite direction to the recess 4*b*. As such, the plate member 500 may be configured so as not to cover the recess 4*b*.

In addition, the plate member 500 may include a center portion 502 surrounding the second shaft 675. The center portion 502 may be formed as plane to be coupled to the second tub 4 stably.

The inclined portion 501 may be extended along a radial direction of the center portion 502. Such the inclined portion 501 may be formed to surround the second rotor 673 from an outer portion in a radial direction of the second rotor 673. The expanded portion 503 may be extended outward in a radial direction from the inclined portion 501.

As mentioned above, the heat generated in the drying duct 91 might be transferred to the second tub 4 in the front portion of the lower back surface. In contrast, the heat generated in the second drive unit might be transferred to the drying duct 91. Accordingly, the plate member 500 is provided to mitigate such heat transfer.

In addition, the heat generated in the second stator 671 is exhausted via the plate member 500 in a radial direction, so as to minimize the heat which might directly heat the drying duct 91.

The plate member 500 may be made of metal and formed in a plate shape. The plate member 500 may be attached to the rear surface of the second tub 4 closely so as to reinforce the strength of the second tub 4 effectively. The plate member 500 may be molded with the rear surface of the second tub 4, especially, the lower back surface. For that, a stepped portion may be formed so that the plate member 500 may be secured to the rear surface of the second tub 4 more closely.

In some implementations, the overall height of the second tub 4 may be determined by the recess 4*a* recessed upward from the center of the second tub 4 and the recess 4*b* recessed downward in the outer portion in the radial direction of the recess 4*a* to secure the second drive unit 67.

The second drive unit 67 is secured in a state of being inserted in the recess 4*a* and the recess 4*b* is more recessed downward than the second drive unit 67. Accordingly, the second rotor 673 may be located higher than the lowermost portion of the second tub 4 only to effectively prevent the driving of the second rotor 673 from interfering with the peripheral devices.

The plate member 500 may cover the second rotor 673. Together with the plate member 500, the recess 4*b* may cover the second rotor 673. When a gap is formed between the second rotor and the plate member and between the plate member and the second rotor, the heat inside the second rotor 673 may be radiated and exhausted downward via the gap.

Referring to FIGS. 1 through 4, the implementation including the plate member 500 and the second stator 671 which are not secured to each other is described.

Figure 5:
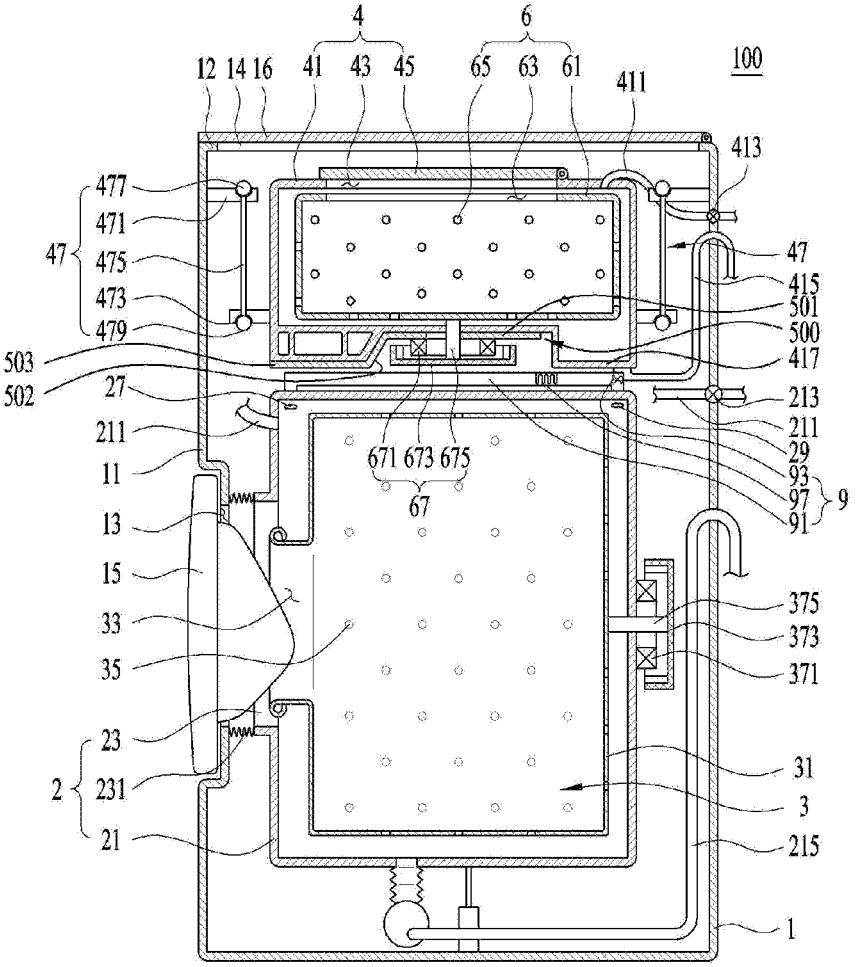
FIG. 5 is a diagram illustrating a further example of a laundry machine.

Hereinafter, referring to FIG. 5, one implementation including the plate member 500 and the second stator 671 which are secured to each other will be described.

As mentioned above, the plate member 500 may be coupled to or integrally formed with the lower back surface of the second tub 4. The plate member 500 may be made of plastic and have a higher strength than plastic. Accordingly, in some implementations, the second stator 671 is secured to the plate member 500, not directly secured to the second tub 4.

For that, the center portion 502 of the plate member 500 may be extended more to the center of the radial direction and a securing portion for securing the second stator 671 may be formed in the center portion 502.

First of all, the heat transferred via the second stator 671 may be radiated outside by the plate member 500 so as to improve the effective securing of the second stator 671 and the heat radiation effect.

In addition, the second drive unit 67 may be secured to the lower back surface of the second tub 4 more stably.

In some implementations, the two washing units according to the implementations mentioned above may not be separate and independent parts. In case one of the washing units is broken, the user is able to use the other one. However, if those washing units are in an inseparable relation, the user seems to recognize them as one product. Accordingly, the interference of the two washing units with each other may be excluded and the unnecessary heat transferring between the two washing units may be effectively shut off may be prevented by using the implementations mentioned above. Accordingly, the laundry machine may have enhanced reliability and durability.

Implementations of the present disclosure may be readily applied to other types of methods and apparatuses. This description is intended to be illustrative, and not to limit the scope of the claims. Many alternatives, modifications, and variations may be made. The features, structures, methods, and other characteristics of the exemplary implementations described herein may be combined in various ways to obtain additional and/or alternative exemplary implementations. As the present features may be embodied in several forms without departing from the characteristics thereof, it should also be understood that the above-described implementations are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A laundry machine comprising:

a tub that is configured to receive water and that defines an opening at an upper surface, wherein a height of the tub is less than a width of the tub;

a drum rotatably disposed in the tub and configured to accommodate clothing; and a drive unit comprising a stator disposed at a bottom surface of the tub and configured to generate magnetic field, a rotor configured to be rotated by the magnetic field, and a rotating shaft coupled to the drum and configured to rotate together with the rotor, wherein the tub defines:

a drainage chamber that protrudes downward from the bottom surface of the tub, that is spaced apart from the stator or the rotor, and that is configured to store water to be drained from the tub, and a recessed portion that is recessed upward relative to the drainage chamber, that is spaced apart from the drainage chamber, and that has an asymmetric shape with respect to the rotating shaft, and wherein the stator is fixed to the bottom surface of the tub in the recessed portion, and the stator and the rotor are entirely accommodated in the recessed portion.

2. The laundry machine of claim 1, wherein the drainage chamber protrudes from a rear of the bottom surface of the tub, wherein the drive unit and the drainage chamber are spaced apart from each other, and wherein the laundry machine further comprises a plate member that is attached to an outer surface of the tub defining the recessed portion and that is spaced apart from the rotor, the stator, and rotating shaft.

3. The laundry machine of claim 2, wherein the plate member is affixed directly to the outer surface of the tub.

4. The laundry machine of claim 2, wherein a first portion of the plate member is integrally formed in the bottom surface of the tub.

5. The laundry machine of claim 4, wherein the first portion of the plate member that is integrally formed in the bottom surface of the tub is a center portion of the plate member that is injection-molded into the bottom surface of the tub.

6. The laundry machine of claim 2, wherein:

the plate member comprises a first portion that surrounds an outer circumference of the drive unit, and the plate member is configured to transfer heat from the first portion surrounding the outer circumference of the drive unit downward to an outside of the tub.

7. The laundry machine of claim 2, wherein the plate member comprises a stepped portion that is molded to the bottom surface of the tub.

8. The laundry machine of claim 2, wherein the tub is composed of plastic, and the plate member is composed of metal.

9. The laundry machine of claim 1, wherein the drainage chamber includes a heating space inside the tub, the heating space being configured to receive heat from an outside of the tub to thereby heat wash water in the tub.

10. The laundry machine of claim 1, wherein the drainage chamber is defined in an outer radial portion of the tub in a radial direction of the rotor of the drive unit.

11. The laundry machine of claim 1, wherein the drainage chamber protrudes from a rear of the bottom surface of the tub, and wherein the drive unit and the drainage chamber are spaced apart from each other.

12. The laundry machine of claim 11, wherein a front distance from a front of the bottom surface of the tub to the recessed portion is different from a rear distance from the rear of the bottom surface of the tub to the recessed portion.

13. The laundry machine of claim 11, wherein a distance between the recessed portion and a front of the drive unit is different from a distance between the recessed portion and a rear of the drive unit.

14. The laundry machine of claim 1, wherein the recessed portion is recessed upward from the bottom surface of the tub such that a lower surface of the stator is positioned higher than a bottom surface of the drainage chamber.

15. The laundry machine of claim 1, wherein a cross section of the recessed portion parallel to the bottom surface of the tub is asymmetric with respect to the rotation shaft.

16. The laundry machine of claim 1, wherein the recessed portion has a front side and a rear side with respect to the rotation shaft, wherein the front side is inclined with respect to a bottom surface of the drainage chamber, and wherein the rear side faces the drainage chamber.

17. The laundry machine of claim 1, wherein a top surface of the stator is in contact with the bottom surface of the tub in the recessed portion, and wherein a bottom surface of each of the stator and the rotor is disposed vertically above a bottom surface of the drainage chamber.

18. A laundry machine comprising:

a first washing unit comprising a first tub, a first drum mounted inside the first tub, and a first drive unit configured to drive a rotation of the first drum around a first rotational shaft inside the first tub; and a second washing unit comprising a second tub, a second drum mounted inside the second tub, and a second drive unit configured to drive a rotation of the second drum around a second rotational shaft inside the second tub, wherein the second washing unit is arranged above the first washing unit and is configured with a second laundry treating capacity that is smaller than a first laundry treating of the first washing unit, and wherein:

a diameter of the second drum is larger than a height of the second drum, and the second rotational shaft is not parallel to the first rotational shaft of the first drum, and the second drive unit comprises a motor connected to the second rotational shaft, the motor comprising a stator and a rotor that are disposed at a lower surface of the second tub, wherein the second tub defines:

a drainage chamber that protrudes downward from the lower surface of the second tub, that extends in a radial outward direction from the motor of the second drive unit, and that is configured to store water to be drained from the second tub, and a recessed portion that is recessed upward relative to the drainage chamber, that is spaced apart from the drainage chamber, and that has an asymmetric shape with respect to the second rotational shaft, and wherein the stator is fixed to the lower surface of the second tub in the recessed portion, and the stator and the rotor are entirely accommodated in the recessed portion.

19. The laundry machine of claim 18, further comprising:

a plate member that is disposed between the motor of the second drive unit and the lower surface of the second tub defining the recessed portion, the plate member being configured to transfer heat from the motor in a downward direction to an outside of the second tub, and wherein the plate member comprises a first plate that is attached to an outer surface of the second tub defining the recessed portion and that faces outer circumferential surfaces of the stator and the rotor.

20. The laundry machine of claim 19, wherein the plate member comprises an inclined portion that surrounds an outer circumference of the rotor, the inclined portion extending downward from a position vertically above the rotor in an outward radial direction.

21. The laundry machine of claim 19, further comprising a cabinet that defines an exterior of the laundry machine, wherein the first washing unit and the second washing unit are provided in the cabinet.

22. The laundry machine of claim 21, wherein at least a portion of a drying duct is provided between a bottom surface of the second washing unit and a top surface of the first washing unit, and wherein the plate member vertically overlays the at least a portion of the drying duct.

23. The laundry machine of claim 19, wherein a bottom surface of the motor is disposed vertically above a bottom surface of the plate member.

24. The laundry machine of claim 18, wherein a bottom surface of the drainage chamber is located at a height that is lower than a bottom outer surface of the motor of the second drive unit.

* * * * *